US008123609B2

(12) United States Patent
Sekiguchi et al.

(10) Patent No.: US 8,123,609 B2
(45) **Date of Patent: *Feb. 28, 2012**

(54) GAMING MACHINE

(75) Inventors: Hirofumi Sekiguchi, Koto-ku (JP); Tatsuhiko Tanimura, Koto-ku (JP)

(73) Assignee: Universal Entertainment Corporation, Tokyo (JP)

( * ) Notice: Subject to any disclaimer, the term of this patent is extended or adjusted under 35 U.S.C. 154(b) by 1008 days.

This patent is subject to a terminal disclaimer.

(21) Appl. No.: 11/144,000

(22) Filed: Jun. 3, 2005

(65) Prior Publication Data

US 2005/0282617 A1 Dec. 22, 2005

(30) Foreign Application Priority Data

Jun. 4, 2004 (JP) ..... 2004-167696

(51) Int. Cl.
*A63F 9/00* (2006.01)

(52) U.S. Cl. ..... 463/20

(58) Field of Classification Search ..... 463/20
See application file for complete search history.

(56) References Cited

U.S. PATENT DOCUMENTS

| | | | | | |
|---|---|---|---|---|---|
| 4,198,147 | A | * | 4/1980 | Alasia | 396/330 |
| 4,306,768 | A | | 12/1981 | Egging | 350/174 |
| 4,454,670 | A | | 6/1984 | Bachmann et al. | 194/350 |
| 4,517,558 | A | | 5/1985 | Davids | 340/700 |
| 4,562,433 | A | | 12/1985 | Biferno | 340/716 |
| 4,568,928 | A | | 2/1986 | Biferno | 340/716 |
| 4,718,672 | A | | 1/1988 | Okada | 273/143 R |
| 5,211,399 | A | * | 5/1993 | Howard | 273/143 R |
| 5,228,693 | A | * | 7/1993 | Howard | 273/143 R |
| 5,283,560 | A | | 2/1994 | Bartlett | 345/113 |
| 5,284,344 | A | * | 2/1994 | Howard | 273/143 R |
| 5,351,966 | A | | 10/1994 | Tohyama et al. | 273/311 |
| 5,393,061 | A | | 2/1995 | Manship et al. | 273/143 R |
| 5,580,055 | A | | 12/1996 | Hagiwara | 273/143 R |
| 5,697,843 | A | | 12/1997 | Manship et al. | 463/20 |
| 5,722,891 | A | | 3/1998 | Inoue | 463/20 |
| 5,725,210 | A | | 3/1998 | Yamaguchi et al. | 273/121 |
| 5,752,881 | A | * | 5/1998 | Inoue | 463/20 |
| 5,810,665 | A | | 9/1998 | Takemoto et al. | 463/31 |
| 5,890,962 | A | | 4/1999 | Takemoto | 463/20 |
| 5,980,384 | A | | 11/1999 | Barrie | 463/16 |
| 6,027,115 | A | * | 2/2000 | Griswold et al. | 273/143 R |

(Continued)

FOREIGN PATENT DOCUMENTS

EP 0 060 019 A1 9/1982

(Continued)

OTHER PUBLICATIONS

"Bigfoot" Product Sheet, Shuffle Master, Inc., 1 page (2000).

(Continued)

*Primary Examiner* — Melba Bumgarner
*Assistant Examiner* — Seng H Lim
(74) *Attorney, Agent, or Firm* — Oblon, Spivak, McClelland, Maier & Neustadt, L.L.P.

(57) ABSTRACT

A gaming machine and associated methodology are provided, including a slot machine having a variable display device providing a plurality of variable displays, and a liquid crystal display device having transmission areas for a surface reflection light reflected at a surface of the variable display device. The variable display device includes a rotary body that is subjected to surface treatment available to suppress a luster and described with a plurality of symbols.

16 Claims, 12 Drawing Sheets

U.S. PATENT DOCUMENTS

| | | | | |
|---|---|---|---|---|
| 6,036,188 | A | 3/2000 | Gomez et al. | 273/118 R |
| 6,038,188 | A | 3/2000 | Akamatsu | 365/226 |
| 6,056,642 | A | 5/2000 | Bennett | 463/20 |
| 6,086,066 | A | 7/2000 | Takeuchi et al. | 273/143 R |
| 6,089,977 | A | 7/2000 | Bennett | 463/20 |
| 6,095,921 | A | 8/2000 | Walker et al. | 463/20 |
| 6,135,884 | A | 10/2000 | Hedrick et al. | 463/20 |
| 6,135,885 | A | 10/2000 | Lermusiaux | 463/20 |
| 6,164,645 | A | 12/2000 | Weiss | 273/138.2 |
| 6,181,301 | B1 | 1/2001 | Inoguchi et al. | 345/5 |
| 6,190,255 | B1 | 2/2001 | Thomas et al. | 463/20 |
| 6,193,606 | B1 | 2/2001 | Walker et al. | 463/20 |
| 6,224,482 | B1 | 5/2001 | Bennett | 463/20 |
| 6,251,013 | B1 | 6/2001 | Bennett | 463/13 |
| 6,261,177 | B1 | 7/2001 | Bennett | 463/16 |
| 6,270,411 | B1 | 8/2001 | Gura et al. | 463/20 |
| 6,290,600 | B1 | 9/2001 | Glasson | 463/20 |
| 6,317,128 | B1 | 11/2001 | Harrison et al. | 345/629 |
| 6,364,766 | B1 | 4/2002 | Anderson et al. | 463/16 |
| 6,368,216 | B1 | 4/2002 | Hedrick et al. | 463/20 |
| 6,375,568 | B1 | 4/2002 | Roffman et al. | 463/26 |
| 6,419,579 | B1 | 7/2002 | Bennett | 463/20 |
| 6,517,432 | B1 | 2/2003 | Jaffe | 463/16 |
| 6,517,433 | B2 | 2/2003 | Loose et al. | 463/20 |
| 6,623,006 | B2 * | 9/2003 | Weiss | 273/138.2 |
| 6,790,140 | B1 * | 9/2004 | Niwa | 463/20 |
| 6,811,273 | B2 * | 11/2004 | Satoh et al. | 362/27 |
| 6,817,946 | B2 | 11/2004 | Motegi et al. | 463/31 |
| 6,824,466 | B1 * | 11/2004 | Hirota | 463/20 |
| 6,923,721 | B2 | 8/2005 | Luciano et al. | 463/24 |
| 6,937,298 | B2 | 8/2005 | Okada | 349/58 |
| 6,976,915 | B2 * | 12/2005 | Baker et al. | 463/1 |
| 7,097,560 | B2 | 8/2006 | Okada | 463/20 |
| 7,140,963 | B2 | 11/2006 | Kojima | 463/20 |
| 7,159,865 | B2 | 1/2007 | Okada | 273/143 |
| 7,160,187 | B2 | 1/2007 | Loose et al. | 463/20 |
| 7,166,029 | B2 | 1/2007 | Enzminger | 463/20 |
| 7,204,753 | B2 | 4/2007 | Ozaki et al. | 463/16 |
| 7,219,893 | B2 * | 5/2007 | Tanimura et al. | 273/143 R |
| 7,255,643 | B2 | 8/2007 | Ozaki et al. | 463/20 |
| 7,275,988 | B2 * | 10/2007 | Aida et al. | 463/20 |
| 7,309,284 | B2 * | 12/2007 | Griswold et al. | 463/29 |
| 7,316,395 | B1 * | 1/2008 | Kromydas | 273/143 R |
| 7,452,276 | B2 * | 11/2008 | Loose et al. | 463/31 |
| 7,458,890 | B2 | 12/2008 | Loose et al. | 463/16 |
| 7,510,475 | B2 | 3/2009 | Loose et al. | 463/31 |
| 7,585,220 | B2 | 9/2009 | Loose et al. | 463/20 |
| 7,730,413 | B1 | 6/2010 | Engel et al. | 715/764 |
| 2001/0000118 | A1 * | 4/2001 | Sines et al. | 273/274 |
| 2001/0000636 | A1 | 5/2001 | Weiss | 273/138.2 |
| 2001/0031658 | A1 | 10/2001 | Ozaki et al. | |
| 2002/0175466 | A1 | 11/2002 | Loose et al. | 273/143 |
| 2003/0060269 | A1 | 3/2003 | Paulsen et al. | 463/20 |
| 2003/0087690 | A1 | 5/2003 | Loose et al. | |
| 2003/0157980 | A1 | 8/2003 | Loose et al. | 463/20 |
| 2003/0234489 | A1 | 12/2003 | Okada | 273/236 |
| 2003/0236118 | A1 | 12/2003 | Okada | 463/20 |
| 2004/0014520 | A1 | 1/2004 | Okada | 463/20 |
| 2004/0021705 | A1 * | 2/2004 | Baker et al. | 347/2 |
| 2004/0029636 | A1 | 2/2004 | Wells | 463/32 |
| 2004/0062025 | A1 | 4/2004 | Satoh et al. | |
| 2004/0063490 | A1 | 4/2004 | Okada | 463/20 |
| 2004/0116178 | A1 | 6/2004 | Okada | 463/20 |
| 2004/0147303 | A1 * | 7/2004 | Imura et al. | 463/16 |
| 2004/0150162 | A1 * | 8/2004 | Okada | 273/292 |
| 2004/0152502 | A1 | 8/2004 | Okada | 463/16 |
| 2004/0166925 | A1 * | 8/2004 | Emori et al. | 463/20 |
| 2004/0166926 | A1 * | 8/2004 | Adachi et al. | 463/20 |
| 2004/0171418 | A1 * | 9/2004 | Okada | 463/20 |
| 2004/0198485 | A1 | 10/2004 | Loose et al. | 463/20 |
| 2004/0200715 | A1 | 10/2004 | Okada | 273/138.1 |
| 2004/0209666 | A1 * | 10/2004 | Tashiro et al. | 463/20 |
| 2004/0209667 | A1 | 10/2004 | Emori et al. | 463/20 |
| 2004/0209668 | A1 * | 10/2004 | Okada | 463/20 |
| 2004/0209670 | A1 * | 10/2004 | Adachi et al. | 463/20 |
| 2004/0209671 | A1 | 10/2004 | Okada | 463/20 |
| 2004/0209672 | A1 | 10/2004 | Okada | 463/20 |
| 2004/0209678 | A1 | 10/2004 | Okada | 463/30 |
| 2004/0209681 | A1 | 10/2004 | Emori et al. | 463/31 |
| 2004/0209682 | A1 * | 10/2004 | Okada | 463/31 |
| 2004/0214635 | A1 | 10/2004 | Okada | 463/30 |
| 2004/0214637 | A1 | 10/2004 | Nonaka | 463/31 |
| 2004/0219965 | A1 | 11/2004 | Okada | 463/16 |
| 2004/0224747 | A1 | 11/2004 | Okada | 463/16 |
| 2004/0224758 | A1 | 11/2004 | Okada et al. | 463/31 |
| 2004/0227286 | A1 | 11/2004 | Tanimura et al. | 273/143 |
| 2004/0227866 | A1 | 11/2004 | Okada | 349/58 |
| 2004/0229680 | A1 * | 11/2004 | Hoshino et al. | 463/20 |
| 2004/0229686 | A1 | 11/2004 | Tanimura et al. | 463/30 |
| 2004/0266510 | A1 | 12/2004 | Kojima | 463/16 |
| 2004/0266515 | A1 | 12/2004 | Gauselmann | 463/20 |
| 2004/0266521 | A1 * | 12/2004 | Kojima | 463/20 |
| 2005/0020349 | A1 * | 1/2005 | Tachikawa | 463/20 |
| 2005/0032571 | A1 * | 2/2005 | Asonuma | 463/20 |
| 2005/0037184 | A1 * | 2/2005 | Halsey et al. | 428/210 |
| 2005/0049030 | A1 * | 3/2005 | Tachikawa | 463/20 |
| 2005/0049032 | A1 * | 3/2005 | Kobayashi | 463/20 |
| 2005/0054433 | A1 * | 3/2005 | Iwamoto | 463/25 |
| 2005/0140088 | A1 | 6/2005 | Randall | 273/143 |
| 2005/0153775 | A1 | 7/2005 | Griswold et al. | 463/30 |
| 2005/0187003 | A1 | 8/2005 | Adachi et al. | 463/16 |
| 2005/0187006 | A1 * | 8/2005 | Tachikawa | 463/20 |
| 2005/0187007 | A1 * | 8/2005 | Kuroiwa | 463/20 |
| 2005/0187009 | A1 * | 8/2005 | Osawa | 463/20 |
| 2005/0192084 | A1 * | 9/2005 | Iwamoto | 463/20 |
| 2005/0192085 | A1 * | 9/2005 | Iwamoto | 463/20 |
| 2005/0192090 | A1 | 9/2005 | Muir et al. | 463/30 |
| 2005/0255908 | A1 | 11/2005 | Wells | 463/20 |
| 2005/0272500 | A1 * | 12/2005 | Tanimura et al. | 463/20 |
| 2005/0282616 | A1 * | 12/2005 | Tanimura et al. | 463/20 |
| 2005/0282617 | A1 * | 12/2005 | Sekiguchi et al. | 463/20 |
| 2006/0014580 | A1 | 1/2006 | Hawthorn | 463/20 |
| 2006/0128467 | A1 | 6/2006 | Thomas | 463/31 |
| 2006/0135248 | A1 | 6/2006 | Anderson et al. | 463/22 |
| 2006/0252496 | A1 | 11/2006 | Rasmussen | 463/20 |
| 2006/0281530 | A1 | 12/2006 | Seelig et al. | 463/20 |
| 2007/0004513 | A1 | 1/2007 | Wells et al. | 463/31 |
| 2007/0054730 | A1 | 3/2007 | Mattice et al. | 463/16 |
| 2007/0149281 | A1 | 6/2007 | Gadda et al. | 463/34 |
| 2009/0131148 | A1 | 5/2009 | Loose et al. | 463/20 |
| 2009/0181758 | A1 | 7/2009 | Loose et al. | 463/20 |

FOREIGN PATENT DOCUMENTS

| | | | |
|---|---|---|---|
| EP | 0 789 338 | A1 | 8/1997 |
| EP | 1 376 495 | A2 | 1/2004 |
| EP | 1 424 663 | A2 | 6/2004 |
| GB | 2 124 505 | A | 2/1984 |
| GB | 2 165 074 | A | 4/1986 |
| GB | 2 253 299 | A | 9/1992 |
| GB | 2 349 494 | A | 11/2000 |
| JP | 61 279272 | | 12/1986 |
| JP | 02 019182 | | 1/1990 |
| JP | 04 109977 | | 4/1992 |
| JP | 04 114676 | | 4/1992 |
| JP | 04 341288 | | 11/1992 |
| JP | 05 177043 | | 7/1993 |
| JP | 06 039085 | | 2/1994 |
| JP | 07 016340 | | 1/1995 |
| JP | 60 061079 | | 4/1995 |
| JP | 07 124290 | | 5/1995 |
| JP | 07 299189 | | 11/1995 |
| JP | 08 103541 | | 4/1996 |
| JP | 2531253 | | 1/1997 |
| JP | 09 207625 | | 8/1997 |
| JP | 10 071228 | | 3/1998 |
| JP | 10 091076 | | 4/1998 |
| JP | 10 305130 | | 11/1998 |
| JP | 10 328398 | | 11/1998 |
| JP | 11 090017 | | 4/1999 |
| JP | 11 099240 | | 4/1999 |
| JP | 11 137774 | | 5/1999 |
| JP | 11 152970 | | 6/1999 |
| JP | 11-153970 | | 6/1999 |
| JP | 11-244451 | | 9/1999 |
| JP | 2000-11725 | | 1/2000 |
| JP | 2000-51314 | | 2/2000 |
| JP | 2000-65097 | | 3/2000 |

| | | | |
|---|---|---|---|
| JP | 2000-68925 | | 3/2000 |
| JP | 2000-262738 | | 9/2000 |
| JP | 2000-350805 | | 12/2000 |
| JP | 2001-062032 | | 3/2001 |
| JP | 2001-252394 | | 9/2001 |
| JP | 2002-113150 | | 4/2002 |
| JP | 2003-236037 | | 8/2003 |
| JP | 2003-260184 | | 9/2003 |
| JP | 2004-8705 | | 1/2004 |
| RU | 2000128696 | | 10/2002 |
| RU | 2001103774 | | 1/2003 |
| WO | WO 99/53454 | A1 | 10/1999 |
| WO | WO 99/64997 | A1 | 12/1999 |
| WO | WO 00/32286 | A1 | 6/2000 |
| WO | WO 2006/036948 | A2 | 4/2006 |
| WO | WO 2006/124976 | A1 | 11/2006 |
| WO | WO 2007/011717 | A2 | 1/2007 |

OTHER PUBLICATIONS

"Big Games Safari" Product Sheet, IGT, 24 pages (2000).
"Cabby Cash™" Product Sheet, Anchor Gaming, 2 pages (2000).
"Congo Quest™" Product Sheet, Anchor Gaming, 2 pages (2000).
"Fishin' Buddies™" Product Sheet, Anchor Gaming, 2 pages (2000).
Legato, Frank, "The Full Monty," Strictly Slots, pp. 48-50 (Jun. 1999).
"Goooaal!" Product Sheet, Bally Gaming, Inc., 2 pages (2000).
"Great Whites" Product Sheet, VLC, Inc., 2 pages (2000).
"Jackpot Stampede Deluxe™" Product Sheet, WMS Gaming Inc., 2 pages (1997).
"Loaded Dice" Product Sheet, Konami Gaming, 2 pages (2000).
"Neptune's Pearls" Product Sheet, Unidesa Gaming, 4 pages (1998).
"Penguin Pays" Product Sheet, Aristocrat Incorporated, 2 pages (1998).
"Stroke of Luck™" Product Sheet, WMS Gaming Inc., 2 pages (1997).
"Wild Cougar" Article, Strictly Slots, p. 44 (Feb. 1999).
"Yahtzee® Brand Video Game" Product Brochure, Hasbro, Inc., 2 pages (2000).
Decision of Refusal of Aug. 30, 2005, issued from Japanese Patent Office for the corresponding Japanese application No. 2000-051314.
Defendant Bally Gaming Inc.'s Answer, Affirmative Defenses, and Counterclaims to Complaint for Patent Infringement; dated Nov. 9, 2010; Civil Action No. 1:10-CV06679; pp. 1-29.
Complaint for Patent Infringement; dated Oct. 16, 2010; pp. 1-64.

* cited by examiner

GAMING MACHINE

CROSS REFERENCE TO RELATED APPLICATIONS

This application is based upon and claims the benefit of priority from the prior Japanese Patent Application No. 2004-167696, filed on Jun. 4, 2004 in the Japanese Patent Office; the entire contents of which are incorporated herein by reference.

BACKGROUND OF THE INVENTION

1. Field of the Invention

The present invention relates to a gaming machine equipped with a display device in front of a variable display device that is capable of showing a plurality of symbols.

2. Description of the Related Art

Heretofore, a gaming machine has been proposed which includes a variable display device (First Display Device) that is capable of showing a plurality of symbols, another display device (Second Display Device: Front Display Device) disposed in front of the variable display device, wherein the symbols on the first display device can be seen through the second display device together with the contents shown on the second display device, during the gaming. For instance, Japanese Patent Application Laid-Open Publication No. 2001-252394 discloses a gaming machine that includes a reel display device and a front display device, which is comprised of a transmission type liquid crystal display device or a transmission EL panel. The gaming machine further includes an illumination device disposed on the front display device at a rear side thereof for illuminating the front display device, and a semi-transmission reflection plate. A light, emitted from the illumination device and reflected at the semi-transmission reflection plate, reaches to an area in front of the front display device to be viewable by a player.

With the gaming machine set forth above, the semi-transmission reflection plate has an area, through which the reel display device can be viewed from a front side of the front display device. Therefore, a portion of the light, emitted from the illumination device, forms a leaked light that transmits through the semi-transmission reflection plate to reach outer peripheries of reels of the reel display device whereby reflections, resulting from the leaked light, appear on the outer peripheries of the reels. For this reason, when viewing the outer peripheries of the reels from the front side of the front display device, such reflections become cumbersome with the resultant issue of a difficulty in viewing the symbols.

In recent years, with the gaming machine of such a type, for increasing a diversity and freedom on effects, it is frequently probable for the front display device to execute the effects of gaming, and the front display device getting play an important role in these days. Further, there is a request for the front display to be largely sized. However, in order for a screen size of the front display device to be largely sized, a need arises for an intensity of a light, emitted from the illumination device, to be increased so as to increase the light intensity arriving at the front area and, when attempting to increase the screen size, the above-described reflections result in a further marked issue.

SUMMARY OF INFORMATION

Thus, the present invention has been completed to address the above issue and has an object to provide a gaming machine in which second display device is disposed in front of a variable display device (first display device), which is able to show a various symbols, to allow displays of both the display devices to be viewable in an overlapped relationship during a gaming and wherein reflections of lights on outer peripheries of reel are minimized to provide the ease of viewing the symbols on the variable display device.

To address the above issue, there is provided a gaming machine comprising: a variable display device variably displaying a plurality of symbols; and a display device disposed in front of the variable display device and having transmission areas for transmitting a surface reflection light reflected at a surface of the variable display device, wherein the variable display device includes a rotary body on which the plurality of symbols are provided and is subjected to surface treatment available to suppress a luster.

DETAILED DESCRIPTION OF THE INVENTION

Figure 1:
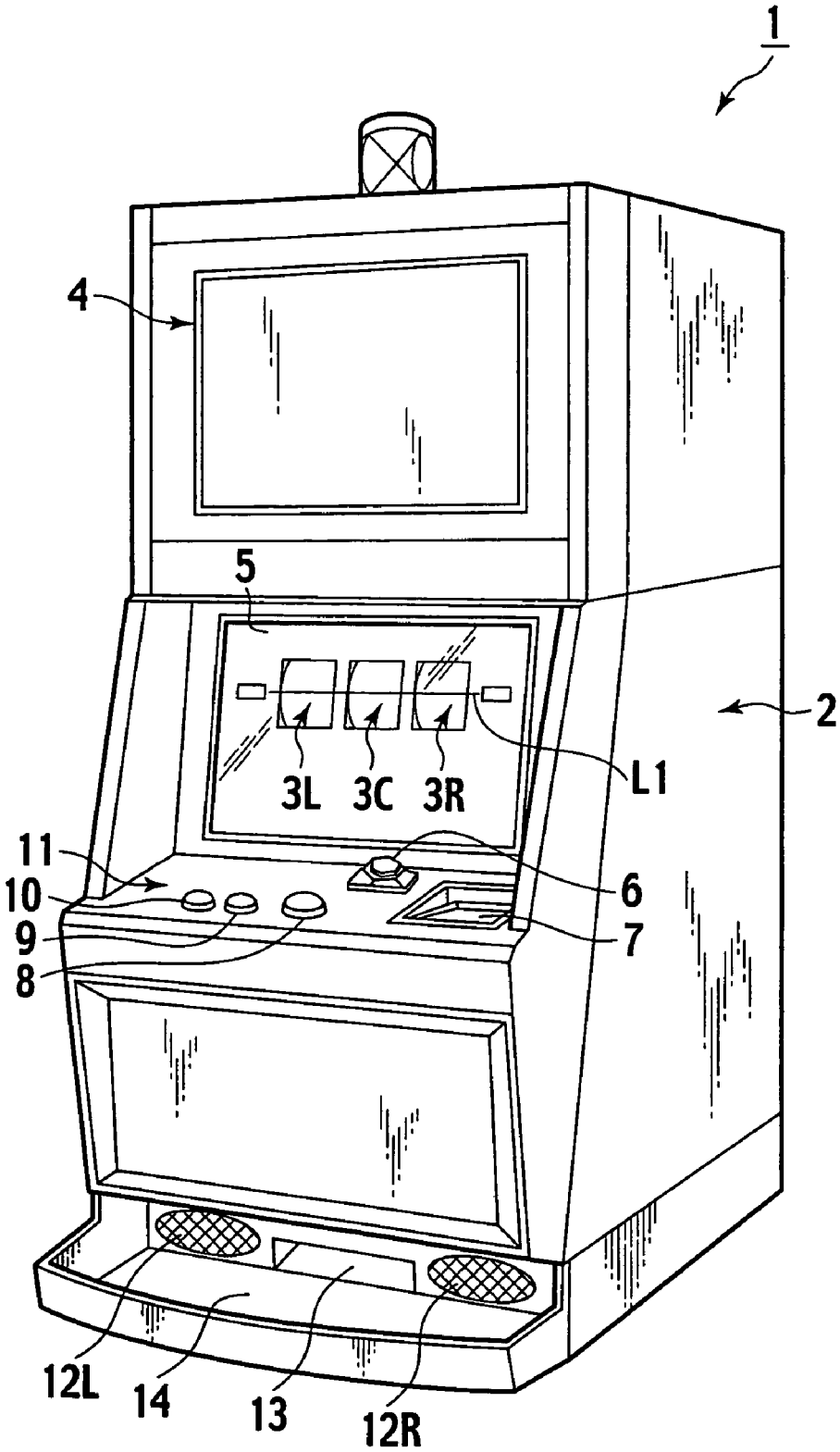
FIG. 1 is a perspective view showing an overall structure of a slot machine of a first embodiment.

Hereinafter, an embodiment of the present invention is described. Also, the same component parts bear like reference numerals to omit redundant description.

The presently filed embodiment will be described below with reference to a case wherein the present invention is applied to a slot machine 1 with a variable display device that is able to show a various symbols.

(Overall Structure of Slot Machine)

With reference to FIG. 1, the slot machine 1 is comprised of a variable display device serving (a first display device) for showing a plurality of symbols, and an image display device (a second display device) disposed in front of the variable display device. The slot machine 1 is configured to enable a slot game using the plurality of symbols that are variably displayed.

The slot machine 1 includes an upper display 4 and a lower display 5 that are placed in front of a cabinet 2, respectively. The lower display 5 is disposed in a substantially central area between a top and a bottom of the cabinet 2. Disposed in an inside of the cabinet 2 in association with the lower display 5 are three mechanical reels 3L, 3C, 3R that rotatably provided along the left side through the right side of the cabinet 2.

Figure 2:
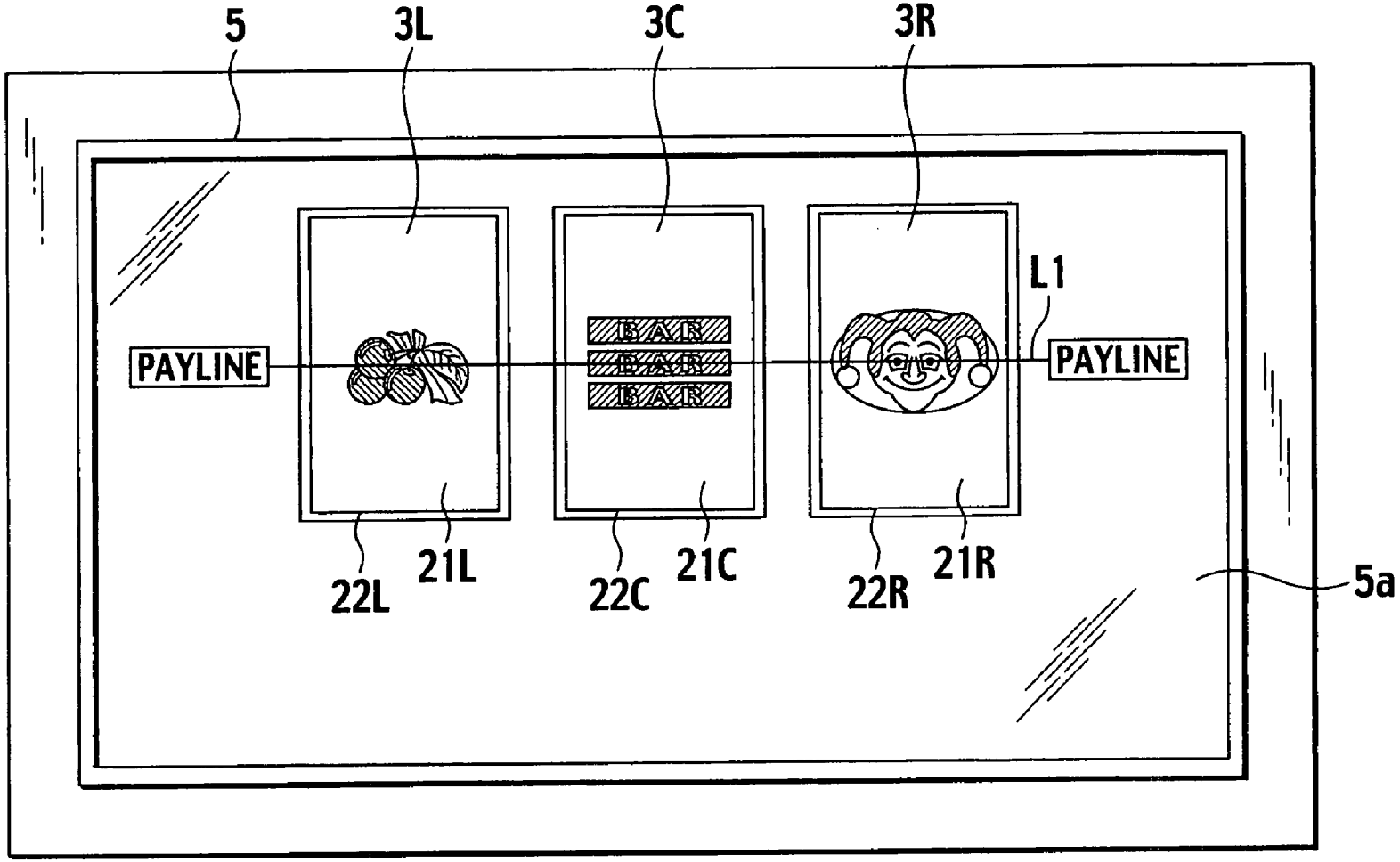
FIG. 2 is a front view showing a lower display of the slot machine shown in FIG. 1.

As shown in FIG. 2, the symbols displayed on the respective reels 3L, 3C, 3R are enabled to be viewable from an outside through symbol display areas 21L, 21C, 21R, which is described below, of the lower display 5. The respective reels 3L, 3C, 3R, which serve as the variable display devices and will be described below, are configured such that rotating the respective reels 3L, 3C, 3R allow the viewable symbols to be variably displayed through the associated symbol display areas 21L, 21C, 21R. Also, the respective reels 3L, 3C, 3R rotate at respective fixed speeds (for instance, 80 rpm).

A horizontally extending payline (straight line) L1 is disposed so that the payline across the symbol display areas 21L, 21C, 21R, respectively. Also, another straight paylines may be disposed in upper and lower areas of the payline L1, respectively, and two oblique paylines may be further disposed. When providing the plural paylines, it may be structured such that the number of paylines to be activated varies depending on the amount of inserted coins. That is, the respective paylines are configured to be activated depending on the number of inserted coins and operations of BET switches 9, 10, respectively. The payline, which is made effective, is referred to as an activated-line. Meanwhile, although only tree symbols ("Cherry", "Bar", "Joker") are shown on one payline L1 in FIG. 2, nine symbols can be shown in 21L, 21C, 21R.

Further, the slot machine 1 is provided with a substantially horizontal base portion 11 in a lower area of the lower display 5. Provided on the base portion 11 are a coin insertion slot 6, a bill insertion slot 7, a spin switch 8, a 1-BET switch 9 and a maximum BET switch 10.

The coin insertion slot 6, provided for a player to insert a coin for using a game, has an inserted-coin sensor 6*a* (see FIG. 7) that outputs a signal indicative of coins being inserted. Further, the bill insertion slot 7, provided for the player to insert a bill, has an inserted-bill sensor 7*a* (see FIG. 7) that outputs a signal indicating of a bill being inserted. By pushing down the spin switch 8, the reels 3L, 3C, 3R are started to rotate whereby a plurality of the symbols can be seen in the symbol displaying areas 21L, 2C, 21R. The 1-BET switch 9 is provided for setting a command to allow one coin to be used for one game. The maximum BET switch 10 is provided for setting a command to allow the maximum number of coins to be wagered for one game.

Further, with the slot machine 1, the cabinet 2 has a bottom portion provided with a coin payout opening 13 and a coin receiving portion 14 configured to receive paid-out coins. In addition, speakers 12L, 12R are provided on both sides of the coin payout opening 13.

(Description about Display Devices)

As shown in FIG. 2, the lower display 5 is comprised of the symbol display areas 21L, 21C, 21R, window frame areas 22L, 22C, 22R, and an effect display area 5*a*. The contents shown on the lower display 5 is changed depend on the combination of the symbols, the state of a stop mode, and a working mode of a liquid display device that will be described below. Also, although the lower display 5 is provided with other component parts such as a BET number display portion 16, a payout display portion 18 and a credit display portion 19, these component parts are omitted from FIG. 2.

The upper display 4 has a liquid crystal display device 101 and is configured to show various contents by the liquid crystal display device 101.

The symbol display areas 21L, 21C, 21R are provided in positions associated with the respective reels 3L, 3C, 3R of the lower display 5 and serves as areas available for the symbols on the respective reels 3L, 3C, 3R, to be viewable. With the symbol display areas 21L, 21C, 21R, the player is able to see the reels 3L, 3C, 3R and the symbols, respectively.

The window frame areas 22L, 22C, 22R are formed so that surround the associated symbol display areas 21L, 21C, 21R, respectively, and serve as display windows for the symbols on the respective reels 3L, 3C, 3R.

Further, the effect display area 5*a* is adapted to show various visual effects to enhance an entertaining and provide useful information about the game to the player.

The upper display 4 is adapted to show a various visual effect based on the operation mode of the liquid crystal display device 101 which will be described below.

(Structures of Reels and LEDs)

Figure 3:
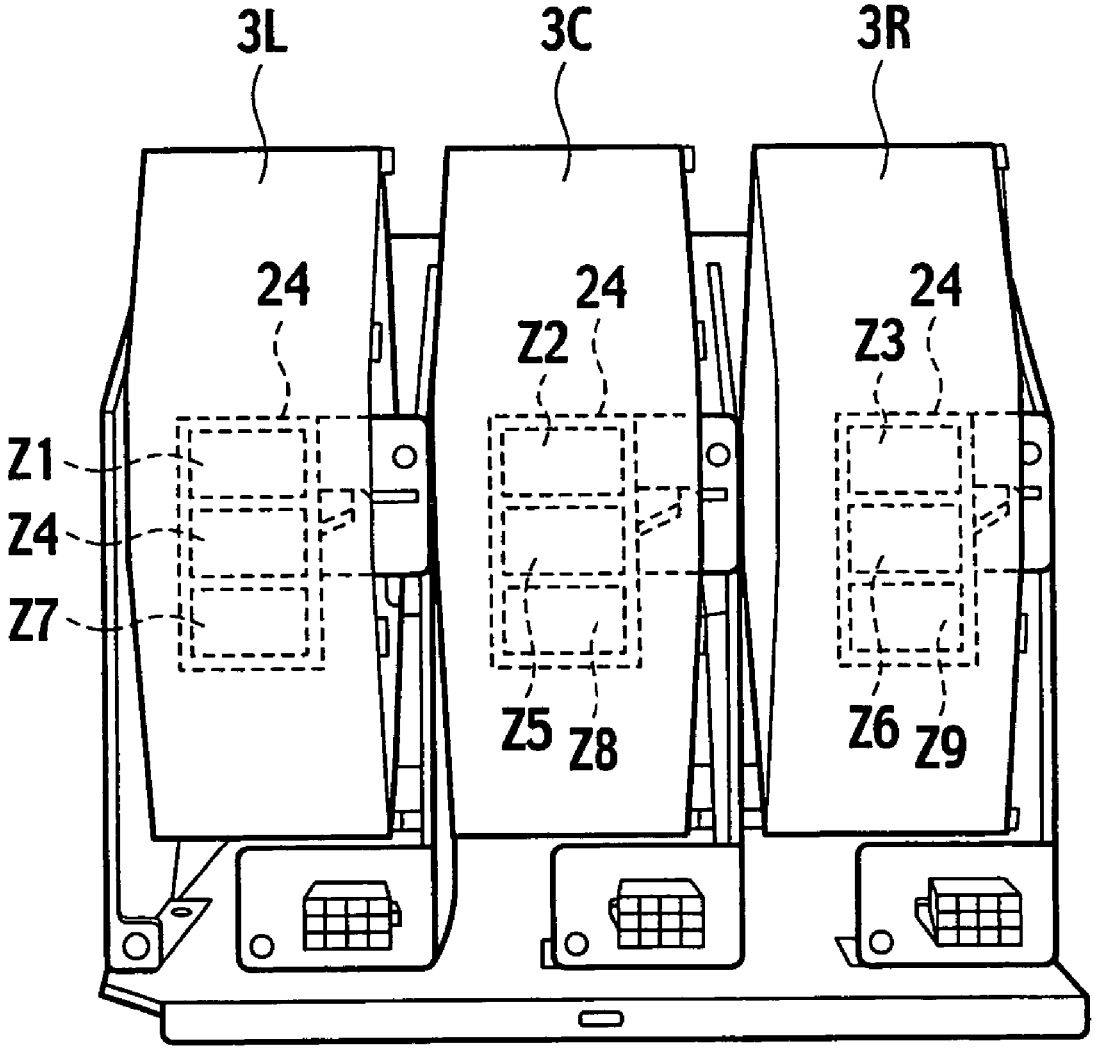
FIG. 3 is a view showing structures of reels.

As shown in FIG. 3, the reels 3L, 3C, 3R is rotatably mounted one by one from left to right to be rotatably mounted, respectively, and have identical structures. Hereunder, the reel 3L is described as an example.

Figure 4:
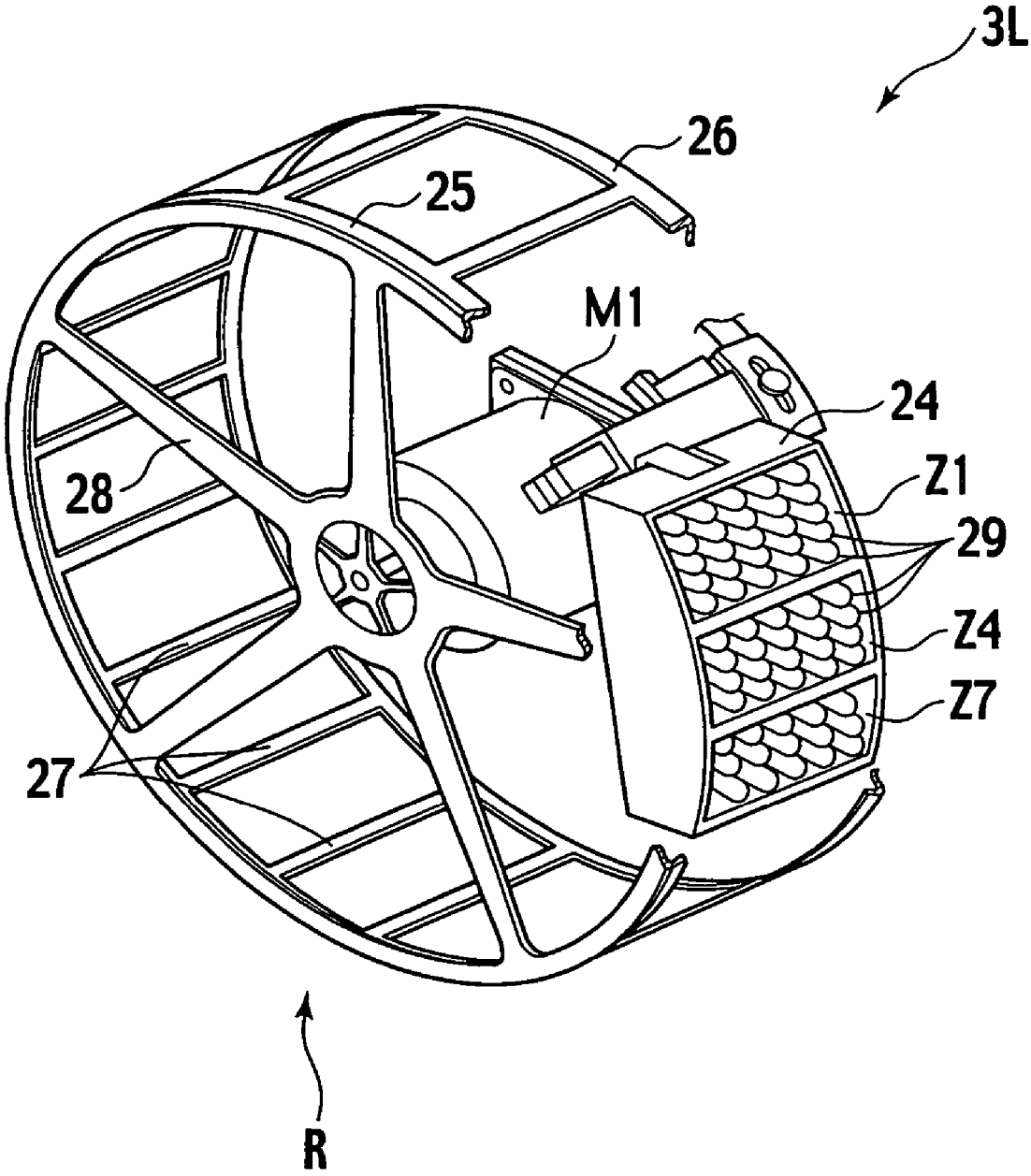
FIG. 4 is a perspective view showing one of the reels shown in FIG. 3.
Figure 11:
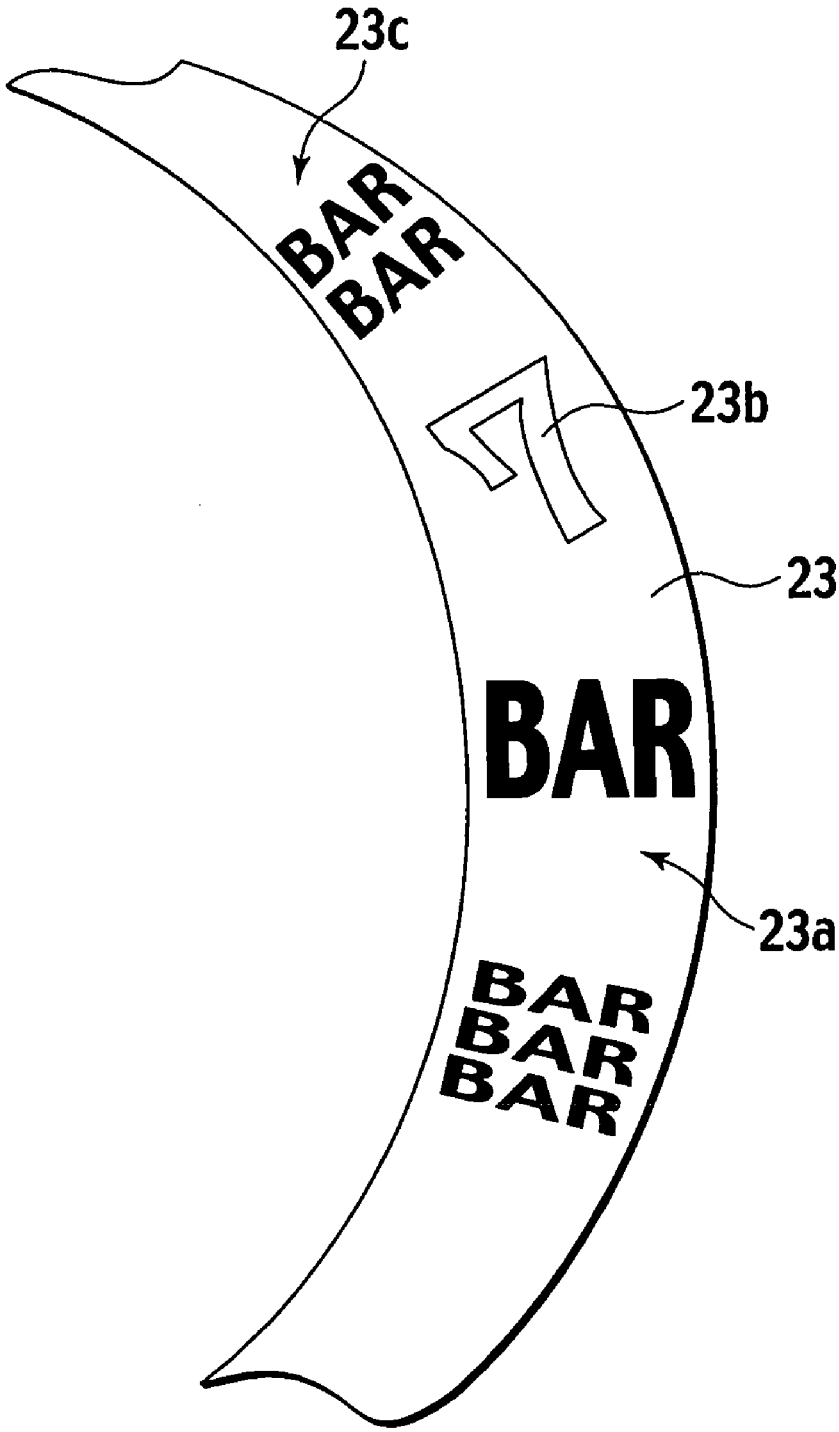
FIG. 11 is a perspective view showing a portion of a reel sheet.

As shown in FIG. 4, the reel 3L includes a cylindrical frame that is comprised of a pair of annular frames 25, 26, formed in an identical structure, which are connected to each other by means of a plurality of connecting members 27. The reel 3L further includes a spoke 28, by which a driving force generated by a stepping motor M1, located at a central area of the cylindrical frames 25, 26, is transferred to the annular frames 25, 26, and a strip-shaped translucent reel sheet 23, shown in FIG. 11, is attached onto outer peripheries of the annular frames 25, 26 to cover the spokes 27. Thus, a rotor R is comprised of the annular frames 25, 26, the connecting members 27 and the spoke 28.

As shown in FIG. 11, a plurality of symbols, such as symbols 23*a*, 23*b*, 23*c*, are provided on the reel sheet 23. The reel sheet 23 is subjected to surface treatment available to suppress the glazing upon permitting a reflected light to be substantially and uniformly diffused in all directions so as not to cause the reflected light to have directional characteristics. Examples of a process for executing surface treatment may include matte (delustering) processing work and embossing work by which a surface is formed with a convexo-concave pattern or embossed pattern.

Further, the reels 3L, 3C, 3R include circuit boards 24, each for accommodating the LEDs 29, which are disposed in areas rearward of the symbols in a matrix of three pieces in a vertical row and three pieces in a horizontal row (with a sum of nine pieces) to appear in the symbol display areas 21L, 21C, 21R when the rotations of the reels 3L, 3C, 3R stop. Each circuit board 24 has three LED receiving portions, juxtaposed along a direction in which each of the reels 3L, 3C, 3R rotates, in each of which a plurality of LEDs 29 are arranged in a matrix pattern as shown in FIG. 4. For the reels 3L, 3C, 3R shown in FIG. 3, the LED receiving portions are illustrated in three rows and the receiving portions bear reference symbols Z1, Z2, Z3, reference symbols Z4, Z5, Z6 and reference symbols Z7, Z8, Z9 for a top row, a central row and a bottom row, respectively, in such an order from the left side. Thus, the respective LEDs serve as a light emitting device by which white lights are irradiated onto the reel sheets 23, respectively, mounted to the reels 3L, 3C, 3R on the outer peripheries thereof, at respective rear sides. The white lights, irradiated from the LEDs 29, transmit through the reel sheets 23 to arrive at front areas (in front of the player) to be illuminated onto the liquid crystal display device 41.

Figure 10:
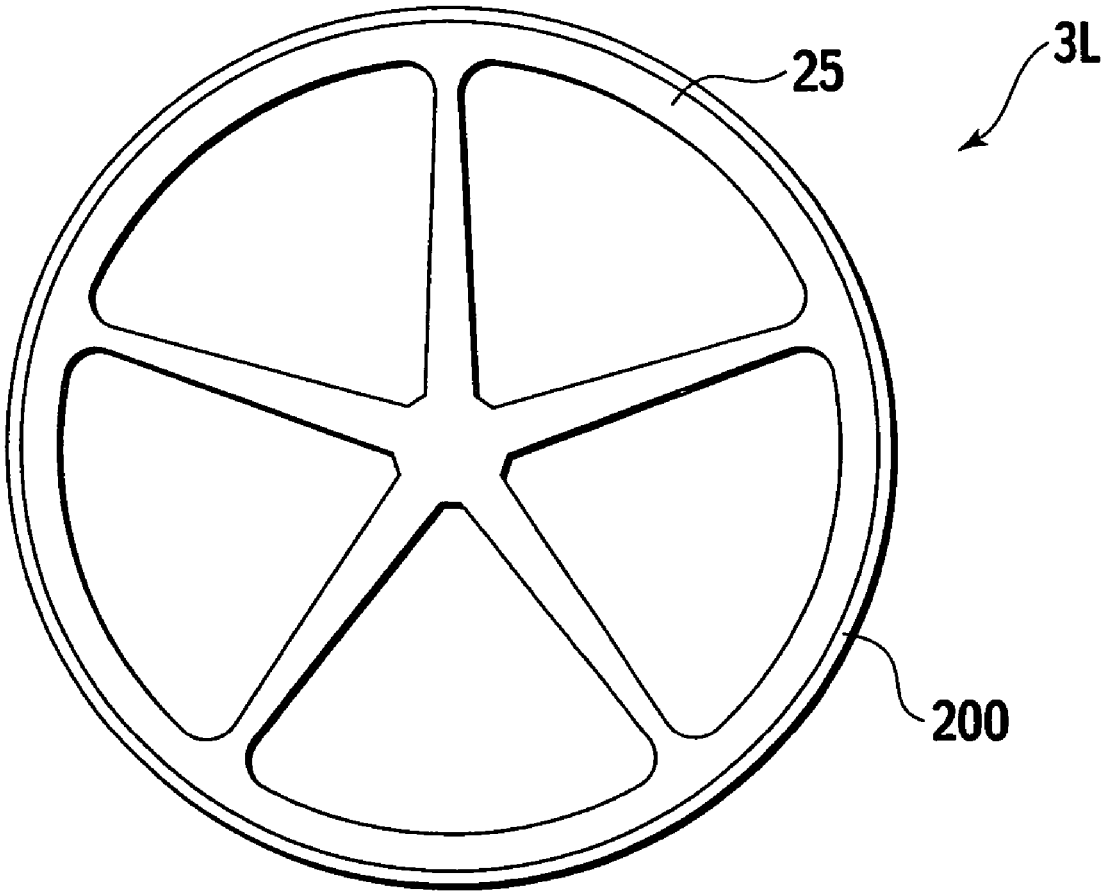
FIG. 10 is a side view showing the reel.

Furthermore, a sheet member 200, formed with a plurality of convex-lens-like protrusions (omitted in FIG. 10), is attached to a surface of the reel sheet 23 as shown in FIG. 10.

(Description of Image Display)

Next, the liquid crystal display device 41, forming the lower display 5, is described with reference to FIGS. 5 and 6.

The liquid crystal display device 41 is located in front (on a side closer to the player) of the reels 3L, 3C, 3R with a given distance therefrom, thereby forming an image display device.

The liquid crystal display device 41 is comprised of a protector glass 42, a display plate 43, a liquid crystal panel 44 and a light guide plate 45 and, a reflector film (reflecting member) 46, cold cathode tubes (first light source) 47*a*, 47*b* disposed substantially directly below (directly above) the light guide plate 45 to serve as white light sources, lamp holders 49*a*, 49*b*, 49*g*, 49*h*, and a flexible circuit substrate (not shown) connected to terminal portions of the liquid crystal panel 44 and including a table carrier package (TCP) on which a driver IC (not shown) for the liquid crystal panel 44 is mounted.

The protector glass 42 and the display plate 43 have a translucency. The protector glass 42 is provided mainly for protecting the liquid crystal display panel 44. A predetermined image is provided on the display panel 43.

The liquid crystal panel 44 is constructed of first transparent substrate plate, such as a glass plate formed with a thin film transistor, and second transparent substrate plate opposed to the first transparent substrate plate, and liquid crystal is sealed between the first and second transparent substrate plate. The liquid crystal panel 44 further includes light transmission areas 44L, 44C and 44R, of the present invention, formed in compliance with the symbol display areas 21L, 21C, 21R to transmit a light from a rear surface. The liquid crystal panel 44 is configured to have a normally white mode, i.e., a light from the back side thereof is able to transmit towards the front side thereof so that the player can see the reels 3L, 3C, 3R, at the null voltage state. That is, by using such liquid crystal panel 44, the symbols on the respective reels 3L, 3C, 3R can be viewable through the symbol display areas 21L, 21C, 21R to enable the player to perform a game even if the sealed liquid crystal cannot be driven. Meanwhile, the light transmission areas 44L, 44C, 44R are may be comprised of an opening, respectively.

The light guide plate 45 has a translucency and is disposed on a rear side of the liquid crystal panel 44 to guide a light emitted from the cold cathode tubes 47*a*, 47*b* to the liquid crystal panel 44.

The light guide plate 45 is formed of a translucent member, such as an acrylic resin having a light guide property, with a thickness of approximately 2.0 cm. As shown in FIG. 6, the light guide plate 45 is formed with transmission openings 45L, 45C, 45R associated with the light transmission areas 44L, 44C, 44R. Further, the light guide plate 45 has a rear side formed with an optical deflection pattern (not shown) and the light transmission openings 45L, 45C, 45R have inner end surfaces 45LX, 45CX, 45RX subjected to light scattering treatment (such as, for instance, a processing to cause a surface to have a refined coarse surface using blast treatment and sand paper). Upon executing the light scattering treatment, if a light is irradiated onto the inner end surfaces 45LX, 45CX, 45RX, the incoming light is scattered such that a player is able to view like the inner end surfaces 45LX, 45CX, 45RX are emitting a light. Also, since this light is also irradiated to the respective reels 3L, 3C, 3R, the light is able to serve as an illumination to illuminate the reels 3L, 3C, 3R. Meanwhile, the player sees the symbols on the respective reel 3L, 3C, 3R along a direction indicated by an arrow "F" in FIG. 6.

A reflection film 46 is provided for reflecting the light, guided to the light guide plate 45, to a front surface of the light plate 45 and made of a white colored polyester film and an aluminum thin film coated with an evaporated silver film. The reflection film 46 includes a reflection area 46A and non-reflection areas 46BL, 46BC, 46BR. The non-reflection areas 46BL, 46BC, 46BR are made of transparent material and perform as a light transmission portion by which an incident light, incoming from the front side, is transmitted without reflection. Further, the non-reflection areas 46BL, 46BC, 46BR are formed in positions associated with the transmission areas 44L, 44C, 44R and placed in front of the symbols in vertical three pieces appearing when the reels 3L, 3C, 3R come to a halt. The reflection area 46A serves to reflects the incident light incoming from the front side and serves as an illumination unit for areas mainly associated with the window frame areas 22L, 22C, 22R and the effect display areas 5*a* among the areas of the liquid crystal panel 44.

Figure 5:
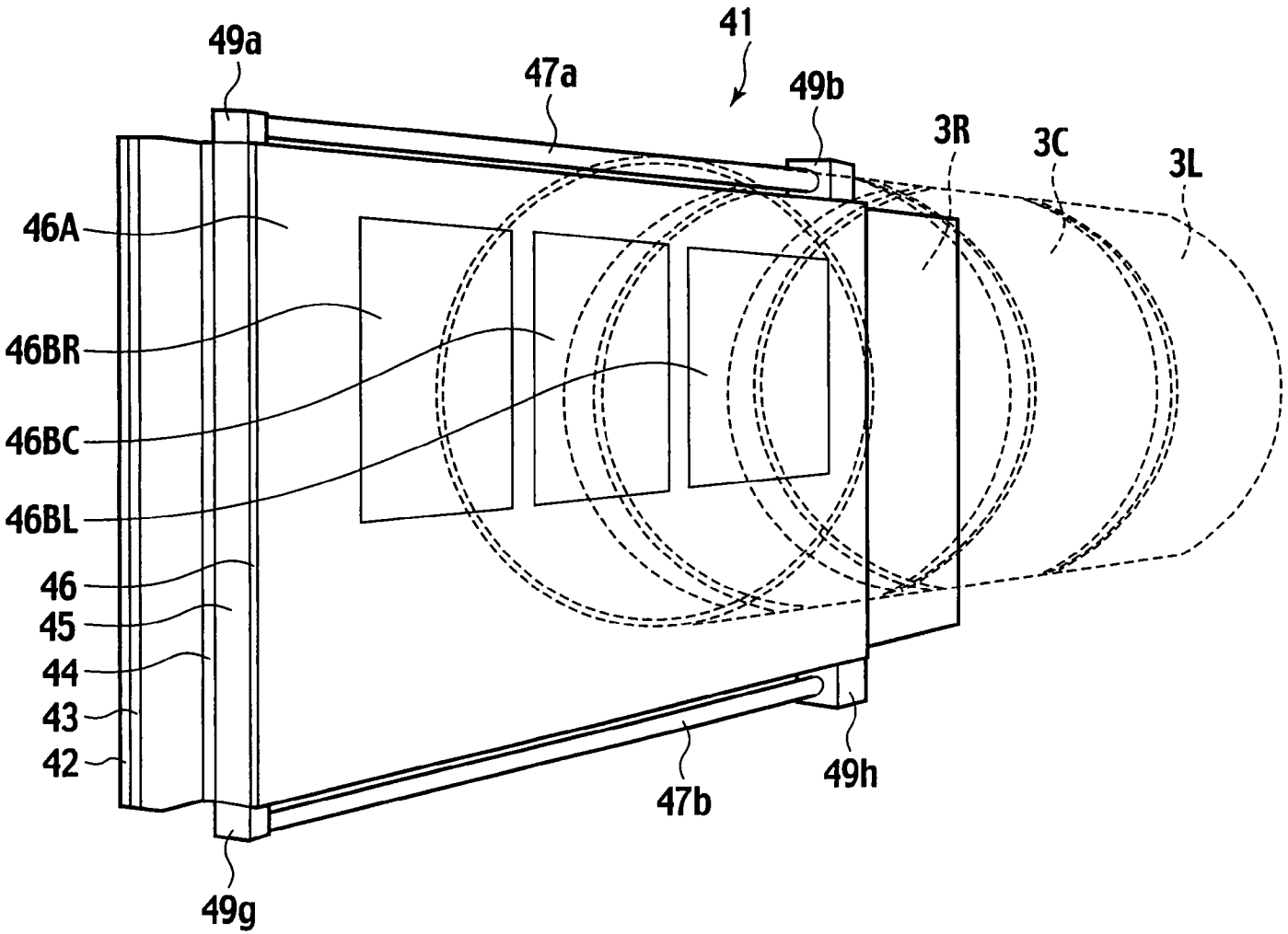
FIG. 5 is a perspective view showing a schematic structure of a liquid crystal display device as viewed from a rear side of a cabinet of the slot machine of a first embodiment.
Figure 6:
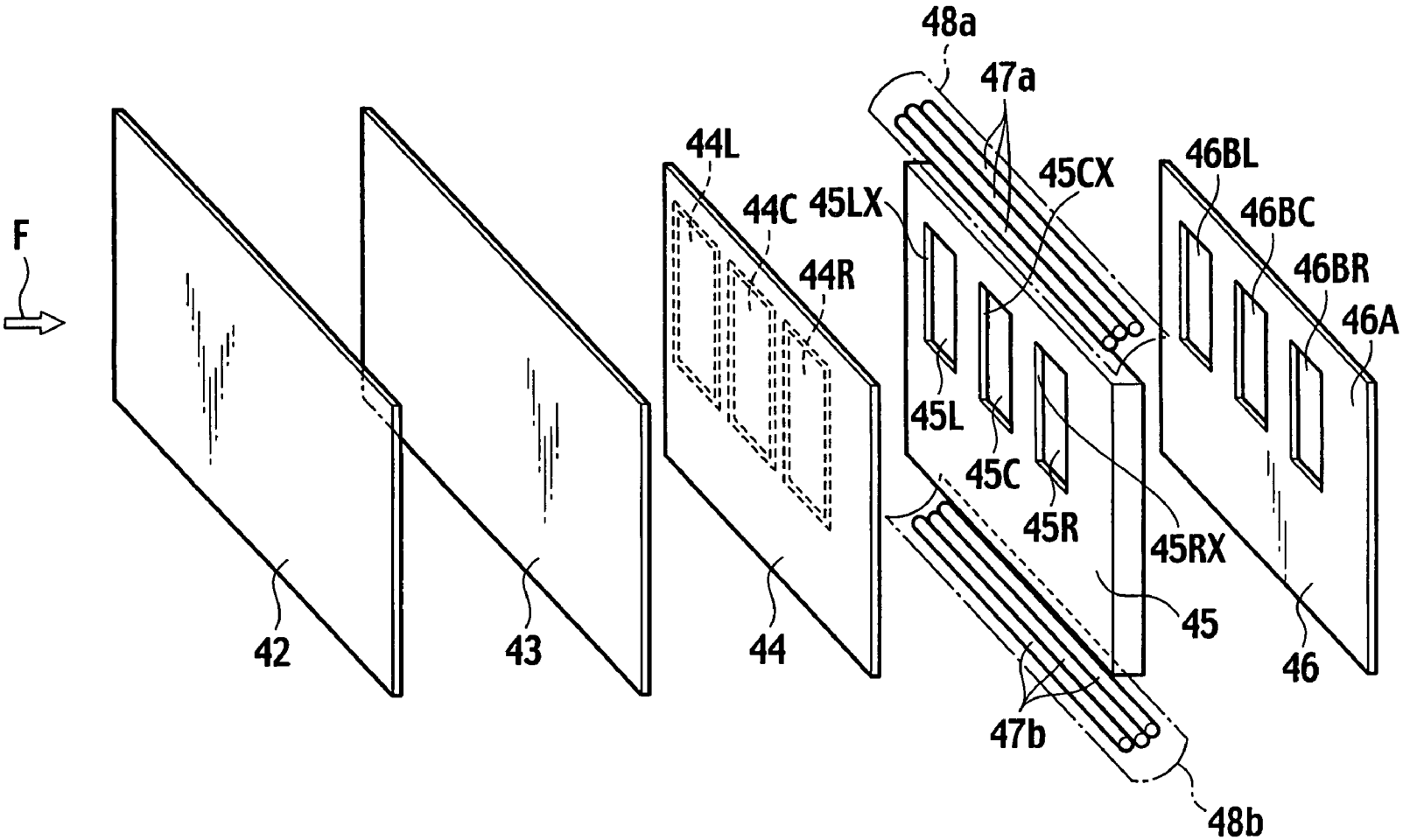
FIG. 6 is an exploded perspective view showing a portion of the liquid crystal display device.

The cold cathode tubes 47*a*, 47*b* are located at an upper end and lower end area of the light guide plate 45, respectively, in group of three pieces (a total of 6 pieces) and have both ends supported by lamp holders 49*a*, 49*b*, 49*g*, 49*h*, respectively, (with the cold cathode tubes 47*a*, 47*b* being shown in one piece, respectively, in FIG. 5 for the sake of convenience). The cold cathode tubes 47*a*, 47*b* emit lights to be guided to the light guide plate 45 and serve as an illumination unit for the areas associated with the window frame areas 22L, 22C, 22R and the effect display areas 5*a* and emit the lights to the rear side via the transmission openings 45L, 45C, 45R.

With the slot machine 1, for the purpose of enabling the lights, emitted from the cold cathode tubes 47*a*, 47*b*, to reach the front side of the liquid crystal display device 41, the cold cathode tubes 47*a*, 47*b* are disposed in group of three pieces on the upper and lower areas of the guide plate 45, respectively, to increase light intensities of the lights to be guided to the light guide plate 45. However, in cases where single pieces of the cold cathode tubes 47*a*, 47*b* are able to allow the lights to surely reach the front side of the liquid crystal display device 41, the number of the cold cathode tubes 47*a*, 47*b* may be less than three pieces and in case where the light intensity per one piece has a less value, a larger number of cold cathode tubes 47*a*, 47*b* than three pieces may be preferably employed.

Further, the cold cathode tubes 47*a*, 47*b* are disposed in lamp cover 48*a*, 48*b* with insides formed with curved reflecting surfaces, respectively. The presence of the lamp cover 48*a*, 48*b* allows the lights, emitted from the cold cathode tubes 47*a*, 47*b* toward an outside of the light guide plate 45, to be guided to the light guide plate 45 without emitting to the outside.

The liquid crystal display device 101 differs from the liquid crystal display device 41 in that the liquid crystal display device 101 does not include the non-reflection areas 46BL, 46BC, 46BR and the transmission areas 44L, 44C, 44R, a touch panel 56, which is described below, is not disposed on the front side and the reels 3L, 3C, 3R are located on the rear side. And the other structures of the liquid crystal display 101 are similar to those of the liquid crystal display device 41.

(Internal Structure of Slot Machine)

Figure 7:
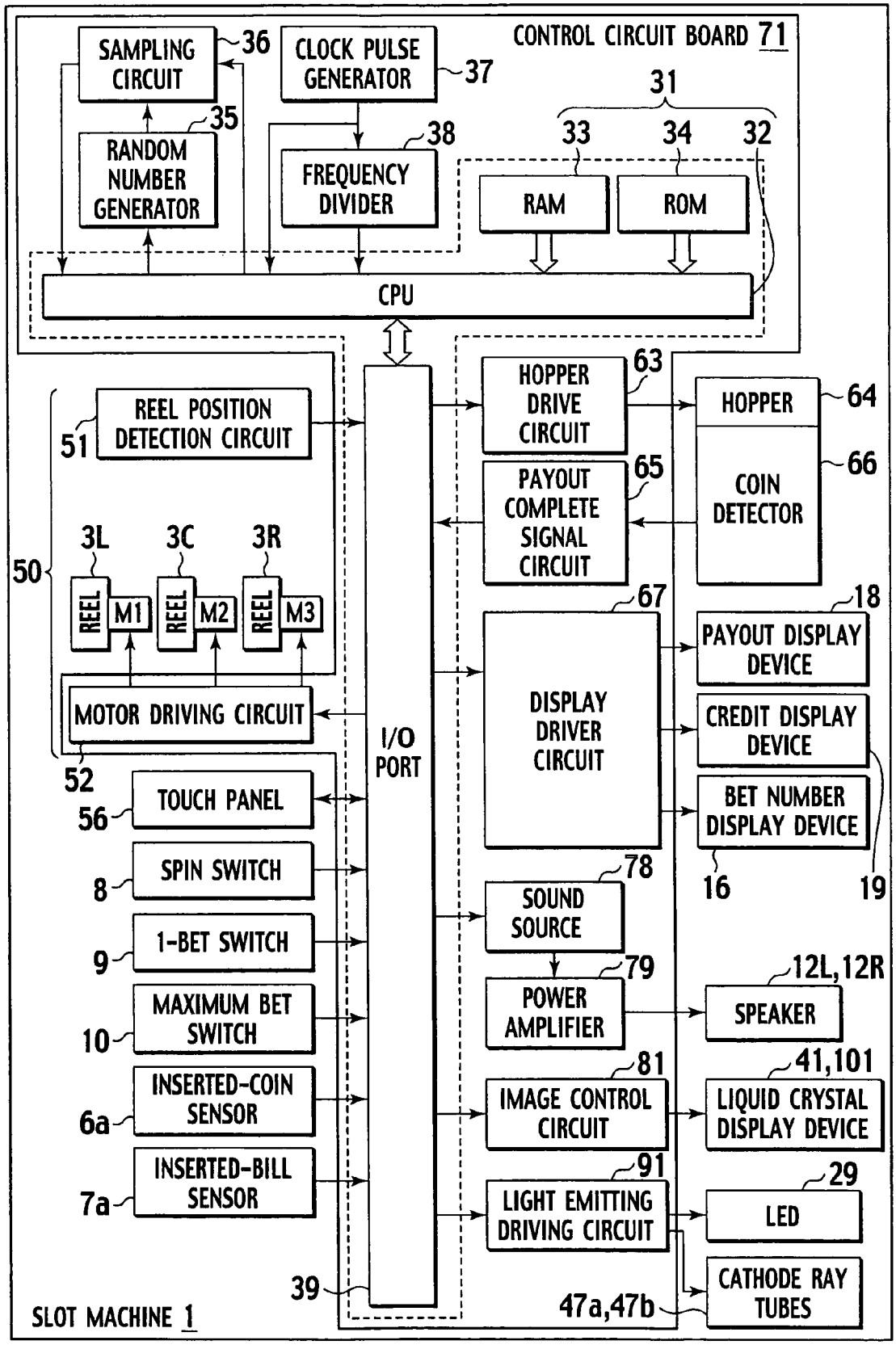
FIG. 7 is a block diagram for illustrating an internal structure of the slot machine.

With reference to FIG. 7, the slot machine 1 is comprised of a control circuit board 71 including a microcomputer 31, a random number generator 35, a sampling circuit 36, a clock pulse generator 37 and a frequency divider 38, a hopper drive circuit 63, a payout complete signal circuit 65, a display driver circuit 67, a sound source 78, a power amplifier 79, an image control circuit and a light emitting driving circuit 91.

The microcomputer 31 includes a CPU (Central Processing Unit) 32, a RAM (Random Access Memory) 33 and a ROM (Read Only Memory) 34. The CPU 32 operates in accordance with programs stored in the ROM 34 while sending signals with the other component parts for thereby achieving control operations of the slot machine 1 as a whole. The RAM 33 stores therein data and programs, to be used for the CPU 32 to operate, which includes, for instance, random numbers subjected to sampling by the sampling circuit 36 (described below) and temporarily stored after a game has been started, code numbers of the reels 3L, 3C, 3R and symbol numbers. Also, the ROM 34 stores therein programs to be executed by the CPU 32, and lasting data.

The random number generator 35 operates in accordance with a command from the CPU 32 to generate random numbers within a certain definite range. The sampling circuit 36 responds to the command from the CPU 32 to extract an arbitrary random number from among the random numbers generated by the random number generator 35, thereafter the extracted random number is inputted to the CPU 32. The clock pulse generator 37 generates reference clock pulses, for operating the CPU 32, which are divided by the frequency divider 38 at a fixed frequency to provide a signal that is inputted to the CPU 32.

Further, connected to the control circuit board 71 is a reel drive circuit 50. The reel drive circuit 50 is comprised of a reel position detecting circuit 51 that detects respective positions of the reels 3L, 3C, 3R, and a motor driving circuit 52 from which drive signals are applied to motors M1, M2, M3 by which the reels 3L, 3C, 3R are rotated, respectively. Upon receipt of the drive signals delivered from the motor driving circuit 52, the motors M1, M2, M3 are operated thereby rotating the reels 3L, 3C, 3R. In addition, a spin switch 8, a 1-BET switch 9, a maximum BET switch 10, an inserted coin sensor 6*a* and an inserted bill sensor 7*a* are connected to the control circuit board 71 to receive signals therefrom, respectively.

The hopper drive circuit 63 drives a hopper 64 in accordance with the control of the CPU 32 to allow the hopper 64 to execute payout operation such that the coins are paid out from a payout opening 13. The payout complete signal circuit 65 is applied with coin count data from the associated coin detector 66 and when a coin count value reaches a preset coin count value, the payout completion signal circuit 65 applies the CPU 32 with a signal giving notification that the payout of coins has been completed. The coin detector 66 measures a number of coins paid out through the hopper 64, with measured coin count data being inputted to the payout complete signal circuit 65. The display driver circuit 67 inputs data to the payout completion signal circuit 65. The display driver circuit 67 controls display operations of respective display devices (a BET number display device 16, a payout display device 18 and a credit display device 19).

Further, upon the sound source 78 receives a command from the CPU 32, the sound source 78 produces a sound control signal with a sound effect to control the speaker 12L, 12R to outputs the sound effect. That is, upon receipt of the sound control signal with the sound effect from the sound source 78, the power amplifier 79 amplifies the sound effect so that the sound effect is produced from the speakers 12L, 12R. By these configurations, various sound effects stored in the sound source are able to output from the speakers 12L, 12R, and with such sound effects with the visual effects, a various sound-visual rich game can be obtained.

Furthermore, connected to the CPU 32 is a touch panel 56. The touch panel 56 is provided to cover a surface of the protection glass 42 in front of the lower display 5.

Figure 8:
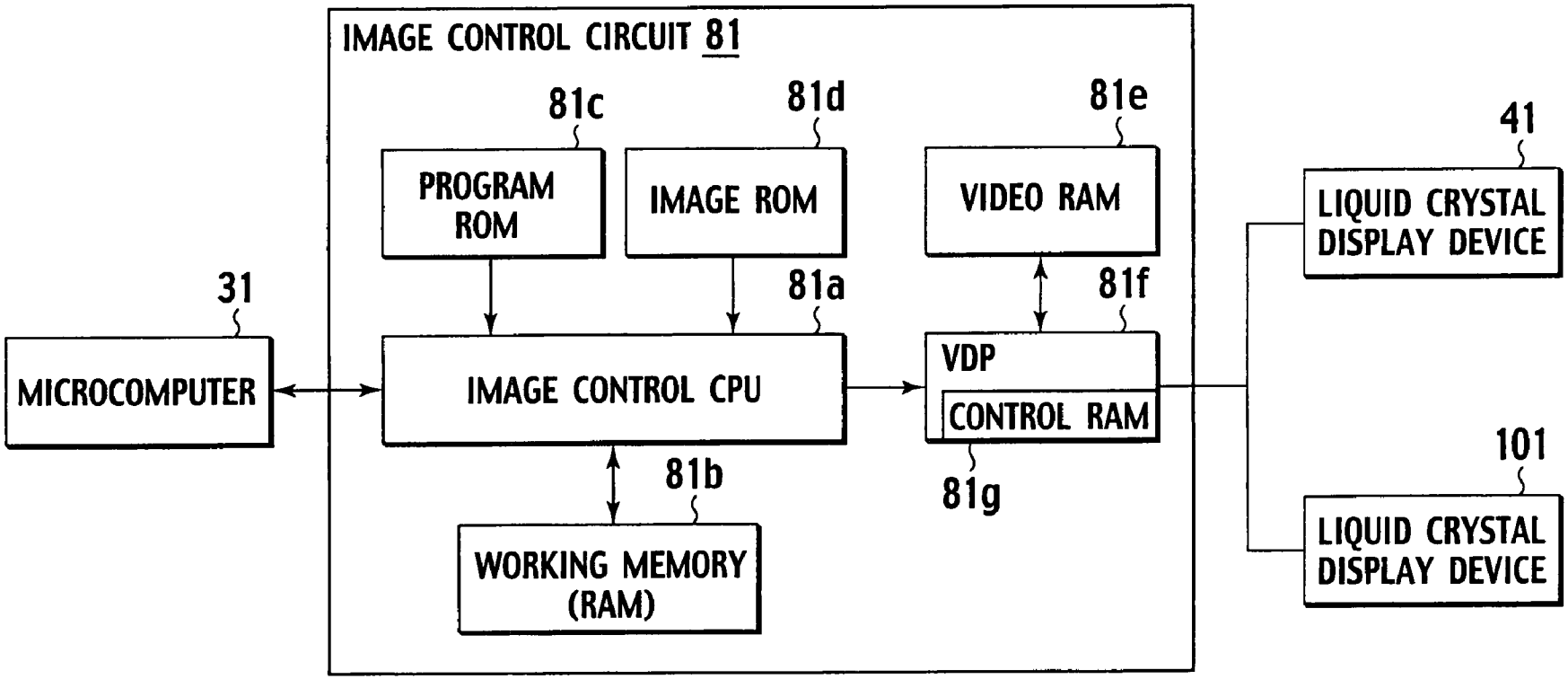
FIG. 8 is a block diagram showing an image control circuit.

The image control circuit 81 controls the liquid crystal display devices 41, 101, respectively. As shown in FIG. 8, the image control circuit 81 is comprised of an image control CPU 81*a*, a working memory (RAM) 81*b*, a program ROM 81*c*, an image ROM 81*d*, a video RAM 81*e* and a VDP (Video Display Processor) 81*f*. The image control CPU 81*a* determines images in accordance with an image control program, which is preliminarily stored in the program ROM 81*c*, for display on the liquid crystal display devices 41, 101 based on parameters preset in the microcomputer 31. Meanwhile, the image control program is provided for liquid crystal display devices 41, 101, respectively. The working memory 81*b* is configured as a temporary storage device that is operative when the image control program is executed by the image control CPU 81*a*.

The program ROM 81*c* stores the image control program and a variety of selection tables. The image ROM 81*d* stores dot data by which the images are formed. The video RAM 81*e* is configured as a temporary storage device that is operative when the image is generated by the VDP 81*f*. The VDP 81*f* has a control RAM 81*g* that produces images depending on display contents of the respective liquid crystal display devices 41, 101 determined by the image control CPU 81*a*, with the respective images being outputted to the liquid crystal display devices 41, 101 for display.

The light emitting driving circuit 91 outputs drive signals depending on commands from the CPU 32 to turn on the LED 29 and the cathode ray tubes 47*a*, 47*b* for emitting lights.

(Operational of Slot Machine)

Next, operations of the slot machine 1 with such a structure are described with reference to a flowchart shown in FIG. 9. The slot machine 1, of the presently filed embodiment, is configured to execute a normal gaming state and a special gaming state. With the normal gaming state, a normal game is played and when the gaming state is shifted to the special gaming state, a bonus game is executed with an advantage for the player.

Figure 9:
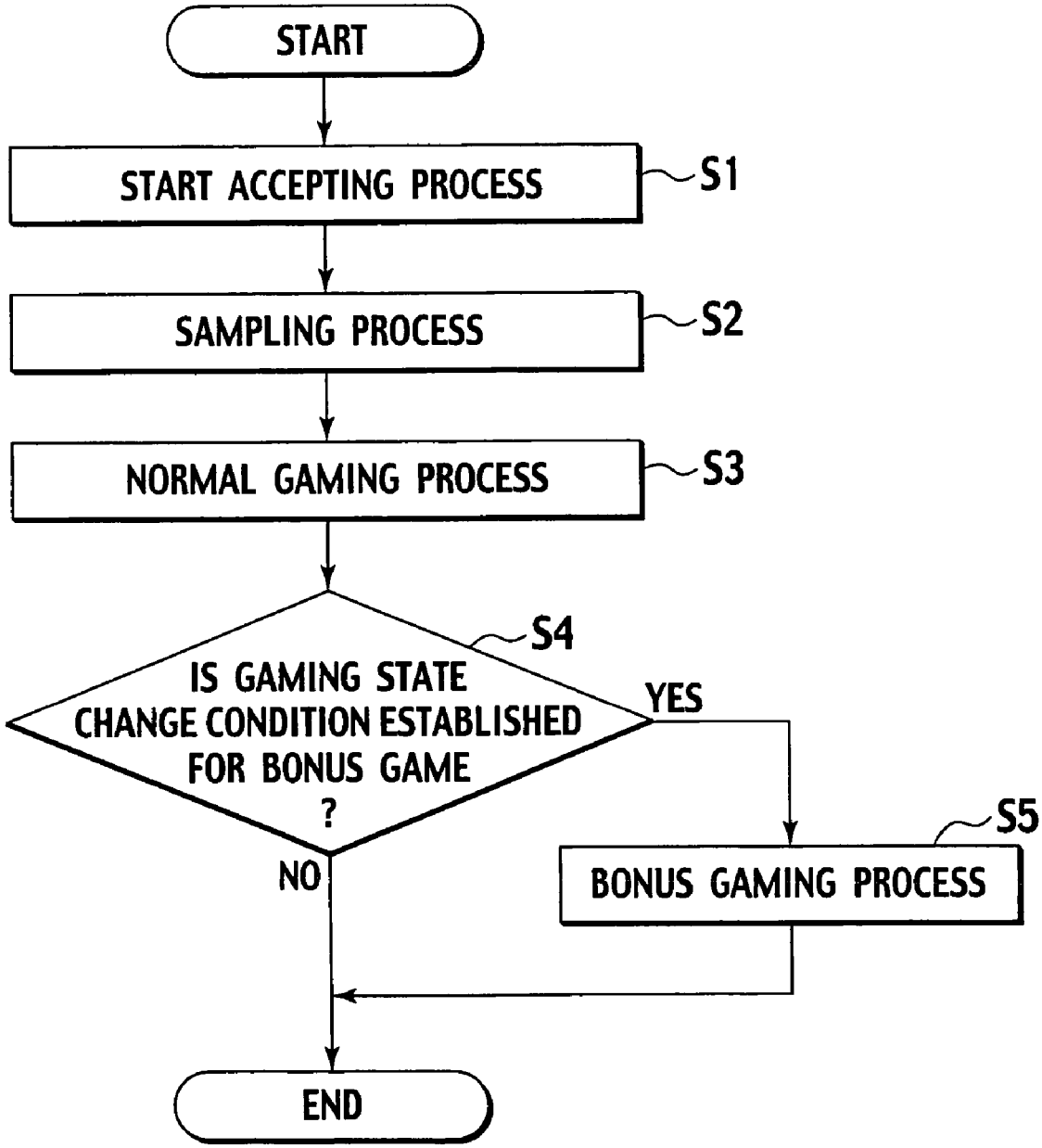
FIG. 9 is a flowchart showing an operational sequence of main operations between a start and end of the slot machine.

FIG. 9 shows a basic operational sequence in parts of main operations to be executed by the slot machine 1 during a period between a start and end of the game. Also, in the FIG. 9, a "step" is abbreviated as "S".

With the main operation started as shown in FIG. 9, in starting a game, the slot machine 1 performs a start accepting process (step 1) controlled by the CPU 32 and thereafter a sampling process is executed (step 2). Next, in step 3, normal gaming process is executed with the gaming state remaining in the normal gaming state in step 3 upon which the process proceeds to step 4. In step 4, upon receipt of a result of the sampling process in step 2, the CPU 32 discriminates whether or not a gaming state change condition is established for the operation to be shifted to the bonus game. Here, if the gaming state change is established, the process goes to step 5 and if not, the main process is completed. As the process goes to step 5, the CPU 32 shifts the gaming state to the spatial gaming state by which the bonus game is implemented. Thereafter, the main process is terminated.

With the structure of the slot machine 1 configured in such a manner described above, the light emitting driving circuit 91 turns on the cathode ray tubes 47*a*, 47*b* in accordance with the command from the CPU 32 in a series of processes described above. Then, lights emitted from the cathode ray tubes 47*a*, 47*b* are guided to the light guide plate 45 upon which a portion of the lights is directed toward the rear side through the light guide plate 45 to form leaked lights that transmit through the non-reflection areas 46BL, 46BC, 46BR (whereas the lights arrived at the reflection area 46*a* is emitted to the front area). In this moment, since the light guide plate 45 has the transmission openings 45L, 45C, 45R, the lights pass through the transmission openings 45L, 45C, 45R into the rear side. Originally, while the cathode ray tubes 47*a*, 47*b* produce the lights for mainly illuminating the liquid crystal panel 44 at the front side thereof, the presence of the reflection film 46, placed on the rear side, which is formed with the non-reflection areas 46BL, 46BC, 46BR allows the portion of the lights to pass through the transmission openings 45L, 45C, 45R with the resultant creation of leaked lights.

Then, the leaked lights arrive at peripheries of the respective reels 3L, 3C, 3R upon which the leaked lights are reflected back on the reel sheets 23, thereby forming a surface reflection light. The surface reflection light sequentially transmits through the non-reflection areas 46BL, 46BC, 46BR on the rear side and pass through the transmission openings 45L, 45C, 45R, the transmission areas 44L, 44C, 44R of the liquid crystal display panel 44, the display panel 43 and the protection glass 42 to be incident onto the front side of the liquid crystal display device 41. In such a way, the surface reflection light is made visible for the player and, hence, the player is enabled to view the symbols provided on the outer peripheries of the respective reels 3L, 3C, 3R.

In such a case, with the slot machine 1, since the reel sheets 23, adhered onto the outer peripheries of the respective reels 3L, 3C, 3R, are subjected to surface treatments available to have controlled luster, the surface reflected lights, reflected on the surfaces of the reel sheets 23, are reflected in all directions in a substantially equalized fashion, causing reduction in intensity of the lights emitted to the front side. Therefore, even if the surface reflected lights are viewed by the player at a position in front of the liquid crystal device 41, adverse affect resulting from the lights emitted from the cathode ray tubes 47*a*, 47*b* are alleviated and the reflection of lights in the eyes of the player become unnoticed. Accordingly, even in the presence of the reflection of the leaked lights caused by the lights emitted from the cathode ray tubes 47*a*, 47*b*, no light is cumbersome for the player to view the symbols, providing the ease of viewing the symbols.

Also, since the slot machine 1 has the respective reels 3L, 3C, 3R inwardly provided with LEDs 29 and the reel sheets 23 has translucency, the presence of light emitted from the LEDs 29 transmits through the reel sheet 23 to reach the front side thereof to be viewed by the player. Therefore, upon lighting up of the LEDs 29, the symbols are illuminated in a lighted-up state, thereby providing a further ease of viewing capability of the symbols.

In such configuration, since the slot machine 1 is configured to allow the symbols on respective reels 3L, 3C, 3R to be clearly viewable, the symbols also can be clearly viewable when the visual contents are displayed on the liquid crystal display device 41. By shown both symbols on the reels 3L, 3C, 3R and the visual contents on the liquid crystal display device 41, a visual rich game can be obtained.

Further, sheet members 200 are adhered onto the outer peripheries of the respective reels 3L, 3C, 3R and each of the sheet members 200 is formed with a plurality of convex lens-shaped protrusions. Therefore, when the LEDs 29 are lighted up, the player is enabled to view the symbols in three dimensions. Also, an example of this kind of sheet member may include a decoration sheet, disclosed in Japanese Patent Laid-Open Publication No. 2003-39583, in which patterns, developed in three dimensions, vary.

Also, while the presently filed embodiment has been described with reference to an exemplary structure of the slot machine 1 having the mechanical type reels 3L, 3C, 3R, of course, the present invention may have another application such as a pachi-slot machine (a Japanese slot-machine) having the mechanical type reels 3L, 3C, 3R.

Further, although the slot machine 1 is provided with the liquid crystal display device 41, a transparent EL panel may be employed in place of the liquid crystal display device 41. The transparent EL panel per se emits a light and, so, the use of such a transparent EL panel enables reduction in a light intensity of a light source to be located on the rear side of the liquid crystal display device 41.

Moreover, the slot machine 1 may have a structure (multi-layered structure) wherein another liquid crystal display device is positioned between the front side of the liquid crystal display device, set forth above, and a transparent acrylic plate to allow the two liquid crystal display devices to be disposed in a multi-layered configuration in a direction along a viewing direction of the payer. With such a multi-layered structure, the lower display 5 is enabled to provide a display of an image with a perspective in a three-dimensional appearance.

Also, although the slot machine 1 has been described with reference to a structure wherein the respective three reels are juxtaposed along a row in a horizontal direction, the number of reels is not limited to three. For instance, five or nine reels may be employed.

Although the slot machine 1 is the gaming machine of the coin insertion type that needs the coins to be inserted for a start of the game, the present invention may be applicable to a gaming machine that needs the use of credit such as the coins for the start of the game or the use of pecuniary information stored in a prepaid card.

(Second Embodiment)

Figure 12:
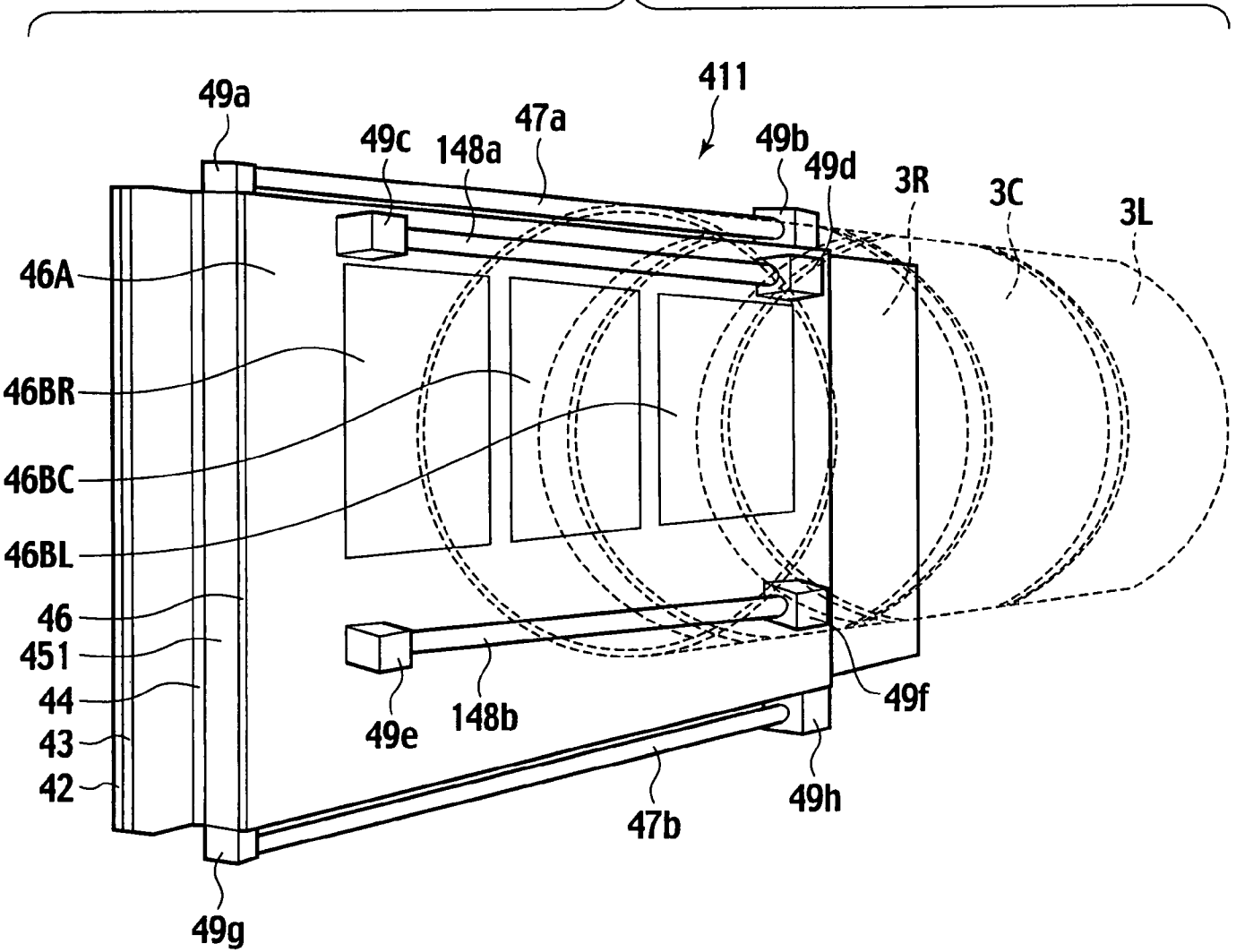
FIG. 12 is a perspective view illustrating a schematic structure of another liquid crystal display device as viewed at the rear side of a cabinet of a slot machine of a second embodiment.

The liquid crystal display device (image display device), conformed to the present invention, may be configured in structure as shown in FIG. 12. The liquid crystal display device 411 takes the form of a structure that includes cathode ray tubes (second light source) 148*a*, 148*b* and a light guide plate 451 of the presently filed embodiment differs from the above-described light guide plate 45 in that no transmission openings 45L, 45C, 45R are provided (single pieces of cathode ray tubes (first light source) 47*a*, 47*b* are provided).

The cathode ray tubes (second light source) 148*a*, 148*b* are located in upper and lower areas on the rear side of the reflection film 46 and held by lamp holders 49*c*, 49*d*, 49*e*, 49*f* to emit lights toward the respective reels 3L, 3C, 3R to illuminate the lights onto the respective reels 3L, 3C, 3R at outer sides thereof. The lights, emitted from the cathode ray tubes 148*a*, 148*b*, reflect at the surfaces of the respective reels 3L, 3C, 3R and are incident on the non-reflection areas 46BL, 46BC, 46BR to cause the lights to reach the liquid crystal panel 44. Thus, the cathode ray tubes 148*a*, 148*b* illuminate the lights onto the symbols on the reel sheets located on the respective reels 3L, 3C, 3R so as to illuminate the lights onto the non-reflection areas 46BL, 46BC, 46BR.

In case of the liquid crystal display device 411, the lights emitted from the cathode ray tubes 148*a*, 148*b* are illuminated onto the respective reels 3L, 3C, 3R but the reflected lights are reduced.

As set forth above, according to the present invention, with the gaming machine equipped with the display device disposed in front of the variable display device that variably display the symbols, no light reflected onto the reel outer peripheries is present and the symbols can be easily viewable in the variable display device.

What is claimed is:

1. A gaming machine comprising:

a variable display device configured to display a plurality of symbols associated with an outcome of a wagering game; and a display device disposed in front of the variable display device, the display device having a first light emitting device and transmission areas, the transmission areas being configured to transmit light emitted from the first light emitting device and reflected off a surface of the variable display device, the display device including:

a liquid crystal panel having the transmission areas, a light guide plate disposed on a rear side of the liquid crystal panel, the light guide plate having transmission regions formed in positions corresponding to the transmission areas of the liquid crystal panel, and a reflection member disposed on a rear side of the light guide plate, the reflection member having non-reflection areas disposed in positions corresponding to the transmission regions of the light guide plate, the variable display device including:

a rotary body, a second light emitting device disposed inside the rotary body, and a translucent reel sheet having the plurality of symbols thereon, the reel sheet having a surface treatment configured to suppress light luster, wherein the reel sheet is attached on an outer periphery of the rotary body to scatter light emitted from the first light emitting device on the reel sheet and transmit light emitted from the second light emitting device through a surface of the reel sheet opposed to the second light emitting device.

2. The gaming machine of claim 1, wherein:

the first light emitting device includes a first light source located proximate the liquid crystal panel and the reflection member, and adjacent at least one of upper and lower areas of the light guide plate;

a first portion of light emitted from the first light source is reflected off a reflection area on a front surface of the reflection member after which the first portion of the light transmits through the light guide plate to form a light source for the liquid crystal panel; and a second portion of the light emitted from the first light source passing through the non-reflection areas is illuminated onto the surface of the reel sheet disposed on the rotary body, after which the light illuminated onto the surface of the reel sheet is reflected toward the liquid crystal panel, whereby an effect displayed on the liquid crystal panel and the plurality of symbols on the reel sheet appear to a viewer to be in an overlapped relationship.

3. The gaming machine of claim 2, wherein the transmission openings of the light guide plate have inner end surfaces that are subjected to light scattering treatment.

4. The gaming machine of claim 1, wherein the first light emitting device includes:

a first light source disposed proximate at least one of upper and lower positions of the light guide plate; and a second light source mounted to the reflection member and emitting light toward the rotary body;

a first portion of light emitted from the first light source is reflected off a reflection area on a front surface of the reflection member, after which the first portion of the light transmits through the light guide plate to form a light source for the liquid crystal panel; and a second portion of the light emitted from the second light source is illuminated onto a surface of the reel sheet disposed on the rotary body after which the light illuminated onto the surface of the reel is reflected toward the liquid crystal panel to subsequently pass through the non-reflection areas, whereby an effect displayed on the liquid crystal panel and the plurality of symbols disposed on the reel sheet appear to a viewer to be in an overlapped relationship.

5. A gaming machine comprising:

a variable display device configured to display a plurality of symbols associated with an outcome of a wagering game; and a display device disposed in front of the variable display device, the display device having a first light emitting device and transmission areas, the transmission areas being configured to transmit light emitted from the first light emitting device and reflected off a surface of the variable display device, the display device including:

a liquid crystal panel having the transmission areas, a light guide plate adjacent the liquid crystal panel, the light guide plate having transmission regions formed in positions corresponding to the transmission areas of the liquid crystal panel, and a reflection member adjacent the light guide plate, the reflection member having non-reflection areas disposed in positions corresponding to the transmission regions of the light guide plate, the variable display device including:

a rotary body, a second light emitting device disposed inside the rotary body, and a translucent reel sheet having a surface treatment configured to suppress a luster and including the plurality of symbols thereon, wherein the reel sheet is attached on an outer periphery of the rotary body to scatter light emitted from the first light emitting device on the reel sheet and transmit light emitted from the second light emitting device through the reel sheet.

6. The gaming machine of claim 5, wherein the surface treatment is by at least one of the group consisting of emboss and matte.

7. A gaming machine comprising:

a variable display device configured to display a plurality of symbols; and a display device disposed in front of the variable display device, the display device having a first light emitting device and transmission areas, the transmission areas being configured to transmit light emitted from the first light emitting device and reflected at a surface of the variable display device;

wherein the variable display device includes:

a rotary body, a second light emitting device disposed proximate the rotary body, and a translucent reel sheet having a surface treatment to suppress a luster and including the plurality of symbols thereon, the reel sheet being attached on an outer periphery of the rotary body to scatter light emitted from the first light emitting device on the reel sheet, the reel sheet directing light emitted from the second light emitting device through the reel sheet;

wherein the display device includes:

a liquid crystal panel having the transmission areas, a light guide plate disposed on a rear side of the liquid crystal panel, the light guide plate having transmission openings formed in positions corresponding to the transmission areas of the liquid crystal panel, a reflection member disposed on a rear side of the light guide plate, the reflection member having non-reflection areas disposed in positions corresponding to the transmission openings of the light guide plate, and the first light emitting device including a first light source disposed in at least one of upper and lower positions of the light guide plate.

8. A gaming machine comprising;

a variable display device configured to display a plurality of symbols; and a front display device disposed in front of the variable display device, the front display device having a first light emitting device and transmission areas, the transmission areas being configured to transmit light emitted from the first light emitting device and reflected at a surface of the variable display device;

wherein the variable display device includes:

a rotary body, a second light emitting device disposed inside the rotary body, and a translucent reel sheet having a surface treatment to suppress a luster and including the plurality of symbols thereon, the reel sheet being attached on an outer periphery of the rotary body to scatter light emitted from the first light emitting device on the reel sheet and transmit light emitted from the second light emitting device through the reel sheet;

wherein the front display device includes, a liquid crystal panel having the transmission areas, a light guide plate disposed on a rear side of the liquid crystal panel, the light guide plate having transmission openings formed in positions corresponding to the transmission areas of the liquid crystal panel, and a reflection member disposed on a rear side of the light guide plate, the reflection member having non-reflection areas disposed in positions corresponding to the transmission openings of the light guide plate;

wherein the first light emitting device includes a first light source located proximate the liquid crystal panel and the reflection member on at least one of upper and lower areas of the light guide plate, a first portion of light emitted from the first light source is reflected at a reflection area on a front surface of the reflection member after which the first portion of the light transmits through the light guide plate to form a light source for the liquid crystal panel, and a second portion of the light emitted from the first light source passing through the nonreflection areas is illuminated onto a surface of the reel sheet disposed on the rotary body, after which the light illuminated onto the surface of the reel sheet is reflected toward the liquid crystal panel, whereby an effect displayed on the liquid crystal panel and the plurality of symbols on the reel sheet appear to a viewer to be in an overlapped relationship.

9. A gaming machine for displaying one or more outcomes of a wagering game, the outcomes being randomly determined from a plurality of wagering game outcomes, the gaming machine comprising:

a first display device including a plurality of symbol-bearing reels, each of the symbol-bearing reels having an interior light emitting device, a rotatable body, and a reel sheet disposed around an outer periphery of the rotatable body, the reel sheet bearing a plurality of symbols associated with the outcomes of the wagering game; and a second display device adjacent the first display device, the second display device having a peripheral light emitting device and light transmission areas, the light transmission areas being configured to transmit light emitted from the peripheral light emitting device, the second display device including:

a liquid crystal panel having the transmission areas, a light guide plate adjacent the liquid crystal panel, the light guide plate defining transmission regions in positions corresponding to the transmission areas of the liquid crystal panel, and a reflection member adjacent the light guide plate, the reflection member having non-reflection areas in positions corresponding to the transmission regions of the light guide plate, wherein the reel sheet has a surface treatment configured to scatter light emitted from the peripheral light emitting device, and a surface transparency configured to transmit light emitted from the interior light emitting device through a surface of the reel sheet opposed to the interior light emitting device.

10. The gaming machine of claim 9, wherein;

a first portion of light emitted by the peripheral light emitting device is reflected off the reflection member and transmitted through the light guide plate to the liquid crystal panel, whereby an effect, displayed over the liquid crystal panel, is viewed through the display plate as a first image, and a second portion of light emitted by the peripheral light emitting device is illuminated onto the reel sheet of the rotary body and then reflected toward the liquid crystal panel to pass through the non-reflection areas, whereby the plurality of symbols are viewed through the display plate as a second image such that ihe first and second images are viewed in an overlapped relationship.

11. The gaming machine of claim 9, wherein ihe peripheral lighl emitting device includes:

a first light source disposed proximate at least one of upper and lower positions of the light guide plate; and a second light source mounted to the reflection member and emitting light toward the rotary body.

12. The gaming machine of claim 9, wherein the reel sheet is subjected to a surface treatment configured to permit a reflected light to be substantially and uniformly diffused in all directions so as not to cause the reflected light to have directional characteristics.

13. The gaming machine of claim 12, wherein the surface treatment forms a convexo-concave pattern.

14. The gaming machine of claim 9, wherein the second light emitting device includes a plurality of light emitting diodes (LEDs) each disposed inside a respective one of the rotary bodies.

15. The gaming machine of claim 9, wherein the surface treatment is provided by at least one of embossing and matting.

16. A gaming machine for displaying one or more outcomes of a wagering game, the outcomes being randomly determined from a plurality of wagering game outcomes, the gaming machine comprising:

a first display device including a plurality of symbol-bearing reels, each of the symbol-bearing reels having an interior light emitting device, a rotatable body, and a reel sheet disposed around an outer periphery of the rotatable body, the reel sheet bearing a plurality of symbols associated with the outcomes of the wagering game; and a second display device adjacent the first display device and having a light emitting device, the second display device including a liquid crystal panel having transmission areas, a light guide plate adjacent the liquid crystal panel, the light guide plate defining transmission regions in positions corresponding to the transmission areas of the liquid crystal panel, and a reflection member adjacent the light guide plate, the reflection member having non-reflection areas in positions corresponding to the transmission regions of the light guide plate, wherein the reel sheet has a surface treatment configured to scatter light emitted from the light emitting device and reflect a portion of the light emitted from the light emitting device toward transmission areas of the second display device, and wherein the reel sheet has a surface transparency configured to transmit light emitted from the interior light emitting device through a surface of the reel sheet opposed to the second display device and toward the transmission areas of the second display device.

* * * * *